US007565977B2

(12) United States Patent
Frenkil

(10) Patent No.: US 7,565,977 B2
(45) Date of Patent: Jul. 28, 2009

(54) SEALABLE BAG WITH EXCESS AIR EVACUATION BLOCKING STRUCTURE

(76) Inventor: Leonard Frenkil, 801 Lancaster St., Baltimore, MD (US) 21202

( * ) Notice: Subject to any disclaimer, the term of this patent is extended or adjusted under 35 U.S.C. 154(b) by 873 days.

(21) Appl. No.: 10/777,184

(22) Filed: Feb. 13, 2004

(65) Prior Publication Data

US 2005/0178691 A1 Aug. 18, 2005

(51) Int. Cl.
*B65D 33/16* (2006.01)

(52) U.S. Cl. ..... 206/524.8; 383/100

(58) Field of Classification Search ..... 383/63, 383/100, 64; 206/524.8
See application file for complete search history.

(56) References Cited

U.S. PATENT DOCUMENTS

| | | | | |
|---|---|---|---|---|
| 2,789,609 | A * | 4/1957 | Post | 383/65 |
| 5,240,112 | A | 8/1993 | Newburger | |
| 5,246,114 | A | 9/1993 | Underwood | |
| 5,544,752 | A | 8/1996 | Cox | |
| 5,908,245 | A * | 6/1999 | Bost et al. | 383/9 |
| 6,039,182 | A | 3/2000 | Light | |
| 6,045,264 | A | 4/2000 | Miniea | |
| 6,076,967 | A | 6/2000 | Beaudette | |
| 6,085,906 | A | 7/2000 | Lambert | |
| 6,231,236 | B1 | 5/2001 | Tilman | |
| 6,499,600 | B2 | 12/2002 | Koyanagi | |

* cited by examiner

*Primary Examiner*—Mickey Yu
*Assistant Examiner*—Jerrold Johnson
(74) *Attorney, Agent, or Firm*—Sidley Austin LLP

(57) ABSTRACT

A sealable bag construction to facilitate the evacuation of excess air that would otherwise be trapped within the sealable bag upon closure. The construction comprises incorporating a blocking structure into the sealable bag by, for instance, attaching, integrally or otherwise, a spacer to material near the opening of a sealable bag, including resealable bags, such that an obstructing portion of the spacer may be temporarily placed in the opening of the bag to prevent the complete sealing thereof, or, in lieu of the spacer, a partial deformation of the sealing means for the sealable bag wherein the deformation is located to provide a temporary stop near, but not at, one end of the opening of the sealable bag. Excess air that would otherwise remain within the bag may thereby be evacuated before the obstructing portion of the spacer is removed (or the deformation is pushed by) and the opening completely sealed.

25 Claims, 6 Drawing Sheets

SEALABLE BAG WITH EXCESS AIR EVACUATION BLOCKING STRUCTURE

BACKGROUND OF THE INVENTION

1. Field of the Invention

The present invention relates to sealable bags. In a specific aspect, it relates to means for more easily evacuating undesirable excess air from a resealable bag.

2. Description of Related Art

Sealable bags are well-known in the art. For instance, Zip-Lock® and Glad-Lock® resealable bags are commonly used for storage of food and other household items. Such resealable bags generally have an opening running substantially the length of one end of the bag and have opposing interlocking strips that run the length of the opening for sealing the bag. When sealed, theses bags are substantially airtight, although air may ingress or egress over the passage of time. Other types of sealable bags exist as well, such as those disclosed in U.S. Pat. No. 6,530,471, issued to Tsuyuguchi, U.S. Pat. No. 6,484,879, issued to Desmarais, U.S. Pat. No. 6,231,553, issued to Hulett, and U.S. Pat. No. 6,029,810, issued to Chen.

A common problem encountered during the use of many such sealable bags is that excess air becomes trapped within the bag when it is sealed. Trapped excess air has the potential to adversely affect the quality of any food stored within the bag. And, trapped excess air causes the bag—filled or otherwise empty—to occupy a greater volume than necessary. Thus, for instance, a resealable bag with food stuff stored within may not fit in a particular storage area, such as a refrigerator drawer, with the additional volume supplied by the accompanying trapped excess air; whereas, if the trapped excess air was substantially removed, the storage area could accommodate the volume supplied by the food stuff and bag alone.

Others have recognized this and similar problems related to trapped air and suggested remedies. U.S. Pat. No. 5,544,752, issued to Cox, discloses a resealable bag wherein the opening of the bag is divided into two sections, a main section for loading and unloading the bag with interlocking strips for sealing the main section, and a small section into which is affixed a hollow tube for evacuating the excess air from the bag after the main section is sealed and within which are installed interlocking strips for sealing the small section after the hollow tube has been used to evacuate trapped excess air. U.S. Pat. No. 6,045,264, issued to Miniea, discloses a resealable bag wherein the opening of the bag is divided into two sections, a main section for loading and unloading the bag with interlocking strips for sealing the main section, and a small section into which may be placed, or slidingly affixed, a hollow tube for evacuating the excess air from the bag after the main section is sealed, or into which may be placed a solid strip for holding the small section open such that excess air may be evacuated from the bag after the main section is sealed, and within which are installed interlocking strips for sealing the small section after the hollow tube or solid strip has been used to evacuate trapped excess air. U.S. Pat. No. 6,085,906, issued to Lambert, discloses a resealable bag wherein the opening of the bag is divided into two sections, a main section for loading and unloading the bag with interlocking strips for sealing the main section, and a small section, the width of which defines the width of a hollow tube that protrudes therefrom for evacuating the excess air from the bag after the main section is sealed, within which are installed interlocking strips for sealing the small section after the hollow tube has been used to evacuate trapped excess air.

Each of these suggested remedies suffer, however, from several problems of their own. Each requires that the opening of the resealable bag be partitioned into two sections, a main section and a small section. And, each suggests that a hollow tube, a relatively complex article of manufacture as compared to a solid strip, be inserted into the small section to facilitate the evacuation of excess air. Only Miniea suggests that a solid strip could also be interested into the small section to facilitate the evacuation of excess air; but, Miniea still requires the partitioning of the opening into two sections. All of these suggested remedies are relatively complex and would seem to add significant additional expense to the manufacture of such resealable bags.

Other suggested remedies found in the prior art are even more complex. U.S. Pat. No. 6,231,236 B1, issued to Tilman, discloses the use of two separate sets of interlocking strips spanning the entire length of the bag opening and the use of a venting structure combined therewith. And, U.S. Pat. No. 6,039,182, issued to Light, U.S. Pat. No. 5,246,114, issued to Underwood, and U.S. Pat. No. 5,240,112, issued to Newburger, all disclose elaborate evacuation structures that are separate and distinct from the interlocking strips used to seal the main opening of the bag.

A need exists for an elegant, and cost-effective, solution to the aforementioned problems.

SUMMARY OF THE INVENTION

Based on the foregoing, it is an object of the present invention to provide sealable bags that facilitate the evacuation of excess air that would otherwise be trapped within the sealable bag upon closure.

It is another object of the present invention to provide such facilitation with a minimum of additional structure beyond that common to sealable bags in general.

It is another object of the present invention to provide such facilitation with such minimum of additional structure being uncomplicated.

It is another object of the present invention to provide such facilitation cost-effectively.

It is another object of the present invention to provide such sealable bags while requiring a minimum of additional manufacturing steps above that common to sealable bags in general.

In the light of these and other objectives, the present invention presents a novel and nonobvious sealable bag construction to facilitate the evacuation of excess air that would otherwise be trapped within the sealable bag upon closure, such construction comprising incorporating a temporary blocking structure into the sealable bag for removable placement into the bag's opening. Said blocking structure may be incorporated by attaching, integrally or otherwise, a spacer in the general shape of a clip, tab, straw or other suitable shape to material near the opening of the sealable bag such that an obstructing portion of the spacer is capable of temporary placement in the opening of the bag to prevent the complete sealing thereof, thus facilitating the removal of excess air that would otherwise remain within the bag, with the preferred contents, before the obstructing portion of the spacer is removed or bypassed and the opening completely sealed. Said blocking structure may also be incorporated by molding, or otherwise attaching, a partial deformation to the sealing means for the sealable bag wherein the deformation is located near one end of the opening of the sealable bag.

The preferred embodiment of the invention comprises a resealable bag with an opening running substantially the length of one end of the bag and having opposing interlocking strips that run the length of the opening for sealing the bag. Attached, integrally or otherwise made a part thereof, to the material of the bag at or near one end of the opening is one end of a spacer, the other end of the spacer left free, said spacer made of flexible material, preferably the same material as the bag and/or interlocking strips, generally a thin and elongated strip or tab, and of such length that the free end of the spacer may be inserted into the opening of the bag near one end of the opening to which the spacer is attached. The insertion of the spacer allows the interlocking strips running the length of the opening to be closed up to the point that the spacer is inserted, the bag can then be depressed such that excess air is expelled out of the portion of the opening still unsealed because of the presence of the spacer, and, when the desired amount of excess air is expelled, the spacer can be removed or displaced and the remainder of the opening sealed so that the bag is sealed with a minimum amount of trapped excess air, and the preferred contents thereof, inside. Said spacer may be manufactured such that it is inserted when the resealable bag is delivered to the consumer or may be left uninserted for insertion by the consumer.

In an alternative embodiment, one end of a spacer is attached, integrally or otherwise, to the material of the bag at one end of the opening, the other end of the spacer left free, said spacer made of flexible material, generally thin and elongated, and of such length that the free end of the spacer may be inserted into the opening of the bag near the end of the opening to which the spacer is attached.

In another alternative embodiment, a spacer is attached, substantially permanently or removably, to the material of the bag near one end of the opening, said spacer of such shape as to allow for frictionable attachment to the bag, for instance a clip, and having an obstructing portion that is or may be placed in the opening of the bag near the end of the opening to which the spacer is attached. Said placement of the spacer allowing the interlocking strips running the length of the opening to be closed up to the point were the spacer is placed, the bag can then be depressed such that excess air is expelled out of the portion of the opening still unsealed because of the presence of the spacer, and, when the desired amount of excess air is expelled, the obstructing portion of the spacer can be removed, either temporarily or permanently, and the remainder of the opening sealed so that the bag is sealed with a minimum amount of trapped excess air, and the preferred contents thereof, inside.

In yet another alternative embodiment, in lieu of the obstructing spacer providing the excess air evacuation through the portion of the opening unsealed because of the presence of the spacer, the actual sealable tract or tracts, for instance the interlocking strips, include a deformation located near, but not at, one of the ends of the opening. Said deformation acting as a blocking structure automatically providing a temporary stop during sealing of the bag such that a small portion of the opening remains unsealed for the evacuation of excess air. After the removal of said excess air the user can complete the sealing by pressing harder to bypass or override the deformation, thus sealing the bag completely.

One of ordinary skill in the art will appreciate that the resealable bag of the preferred and other embodiments may be made of many different materials and in many different shapes and sizes and by many different processes. Likewise, the interlocking strips that run the length of the opening may be made of many different materials and in many different shapes and sizes and by many different processes. Or, the opening may be sealed by means other then interlocking strips, such means being suitable for creating a substantially airtight seal of the opening of the bag. Furthermore, the various blocking structure embodiments—for instance, the tab or straw-shaped spacer or the deformation—may be made of any flexible material and in any size and shape such that, for instance, one end of the spacer may be attached to the material of the bag at one end of the opening and the other end of the spacer may be inserted into the opening or the deformation is formed in conjunction with the interlocking strips at or near one end of the opening. The clip-shaped and other frictionally attached spacer embodiments may likewise be made of any material and in any suitable size and shape. And, the spacer or deformation may be attached to, or made a part of, the bag, including its interlocking strips, in many different ways, using many different manufacturing processes, for instance heat-sealing, ultrasonic bonding, integral molding or the friction associated with a clip attachment.

Other modifications, embodiments, and uses of the present invention will be apparent to those of ordinary skill in the art having reference to the following, together with the drawings.

BRIEF DESCRIPTION OF THE DRAWINGS

The present invention will be described and understood more easily with reference to the accompanying drawings which are not limiting of the invention but are illustrative of the preferred and other embodiments.

DETAILED DESCRIPTION OF THE INVENTION

With reference to the drawings, FIGS. 1-8 depict the preferred and other embodiments of the present invention, resealable bags 10.

Figure 1:
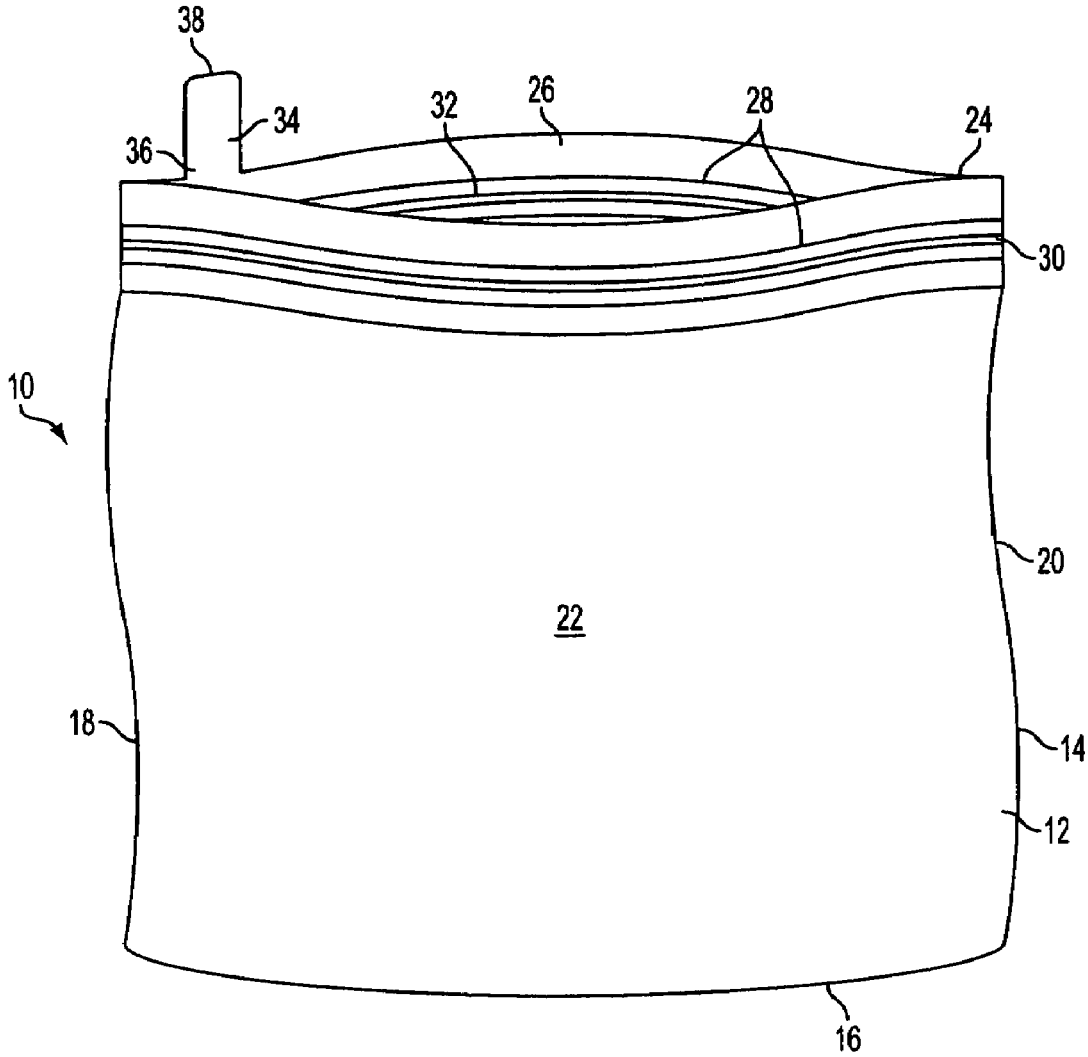
FIG. 1 is a perspective view of the preferred embodiment of the present invention.
Figure 2:
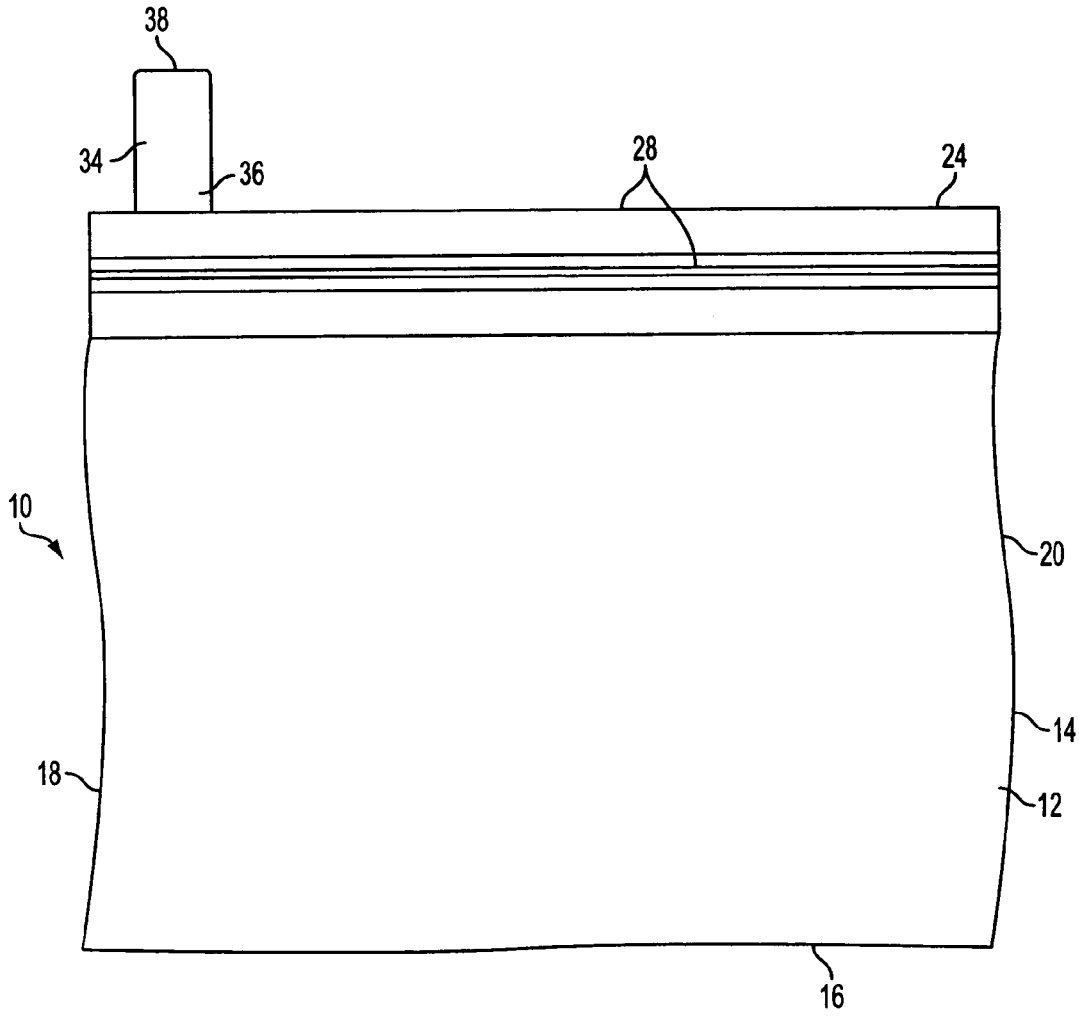
FIG. 2 is an elevation view of the preferred embodiment of the present invention.

Referring to FIGS. 1 and 2, the preferred embodiment of the present invention, the resealable bag 10 comprises a first panel 12 and a second panel 14, each panel being generally square or rectangular and having four edges. Said first and second panels 12, 14 are substantially permanently sealed, preferably heat-sealed, along three edges forming a bottom end 16, a left side 18, and a right side 20 of the bag 10, and thus forming a pouch 22. The fourth edge of the panels is not permanently sealed and forms a top end 24, defining an opening 26 when unsealed, thus allowing ingress and egress of items in and out of the pouch 22 through the opening 26. The top end 24 has an interlocking tongue and groove system 28 for selective sealing and unsealing the opening 26. The interlocking tongue and groove system 28 includes a tongue strip 30 and a groove strip 32 affixed to opposite panels 12, 14 near the top end 24 such that the tongue and groove strips are aligned to interlock when pressed together, said strips 30, 32 running substantially the entire length of the top end 24. The resealable bag further includes a blocking structure comprising a generally thin, tab-like spacer 34 having a first end 36 and a second end 38. The first end 36 of said spacer 34 is attached, integrally or otherwise, to the top end 24 near one of the sides 18, 20 such that the second end 38 of the spacer 34 may be inserted into the opening 26 defined by the top end 24. Of course, said spacer 34 may be manufactured such that said second end 38 is delivered to the consumer already inserted into the opening 26.

The panels 12, 14 may be made from two sheets of flexible plastic film material, e.g. polyethylene, as is well known in the art. Alternatively, instead of two panels 12, 14, one folded sheet of flexible plastic film material may be used as is also well known in the art. Of course, when one sheet is folded into two halves, the side defined by the fold may be considered sealed in a substantially airtight manner.

The tongue and groove strips 30, 32 may be molded integrally with the panels 12, 14 or affixed to the panels 12, 14 during the manufacturing process. Alternatively, all other sealing means known in the art that are capable of providing a similar seal may be used instead of the tongue and groove system 28.

The spacer 34 may be made of any flexible material, preferably the same material used to manufacture either the panels 12, 14, the strips 30, 32, or both. The spacer 34 may be attached by heat-sealing, ultrasonic bonding, integral molding or any other suitable method known in the art, for instance it may be made as an integral part of one of the panels 12, 14. For the purposes of the present invention, the spacer 34 may be part of either of the panels 12, 14.

Figure 3:
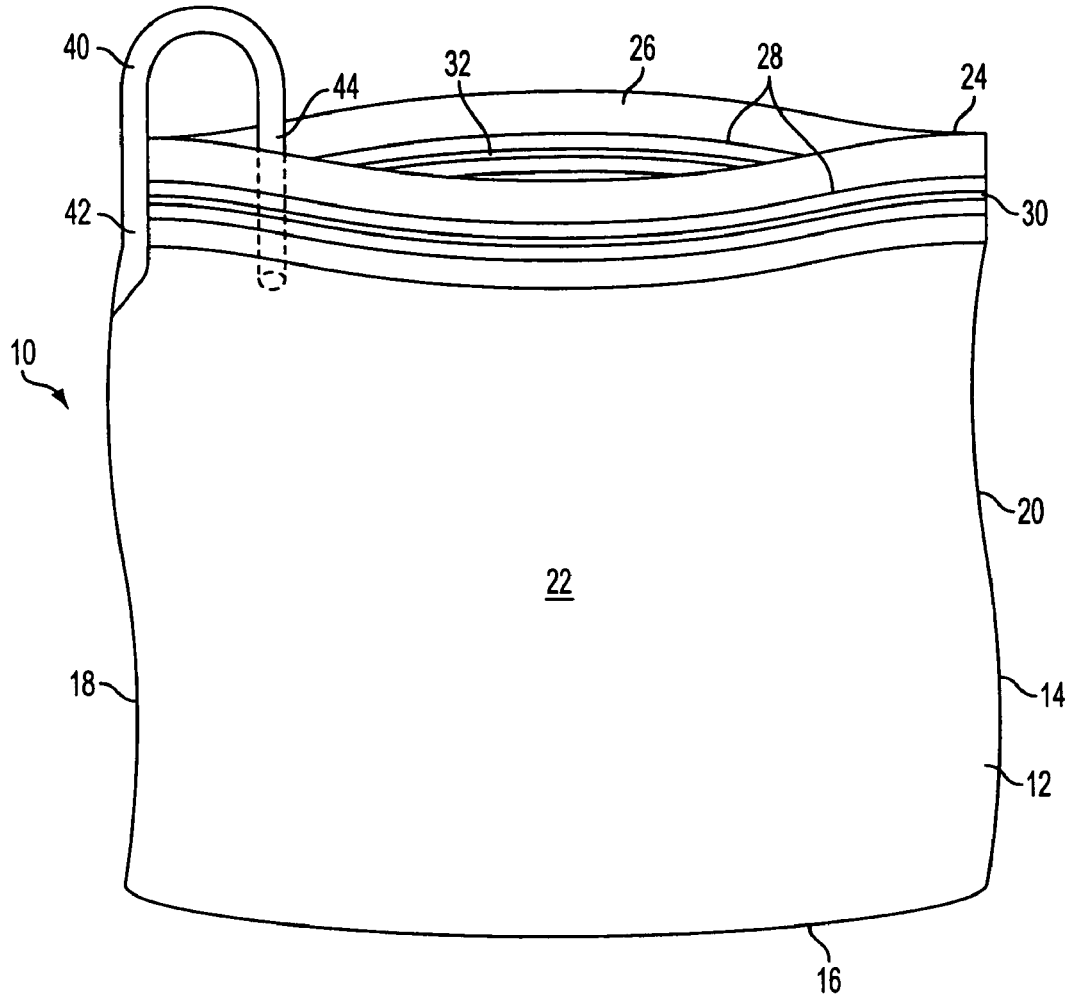
FIG. 3 is a perspective view of another embodiment of the present invention.

Referring to FIG. 3, another embodiment of the blocking structure of the present invention, the resealable bag 10 further comprises a generally thin and elongated spacer 40 having a first end 42 and a second end 44. The first end 42 of said spacer 40 is attached, integrally or otherwise, to one of the sides 18, 20 near the top end 24 such that the second end 44 of the spacer 40 may be placed in the opening 26 defined by the top end 24.

Figure 4:
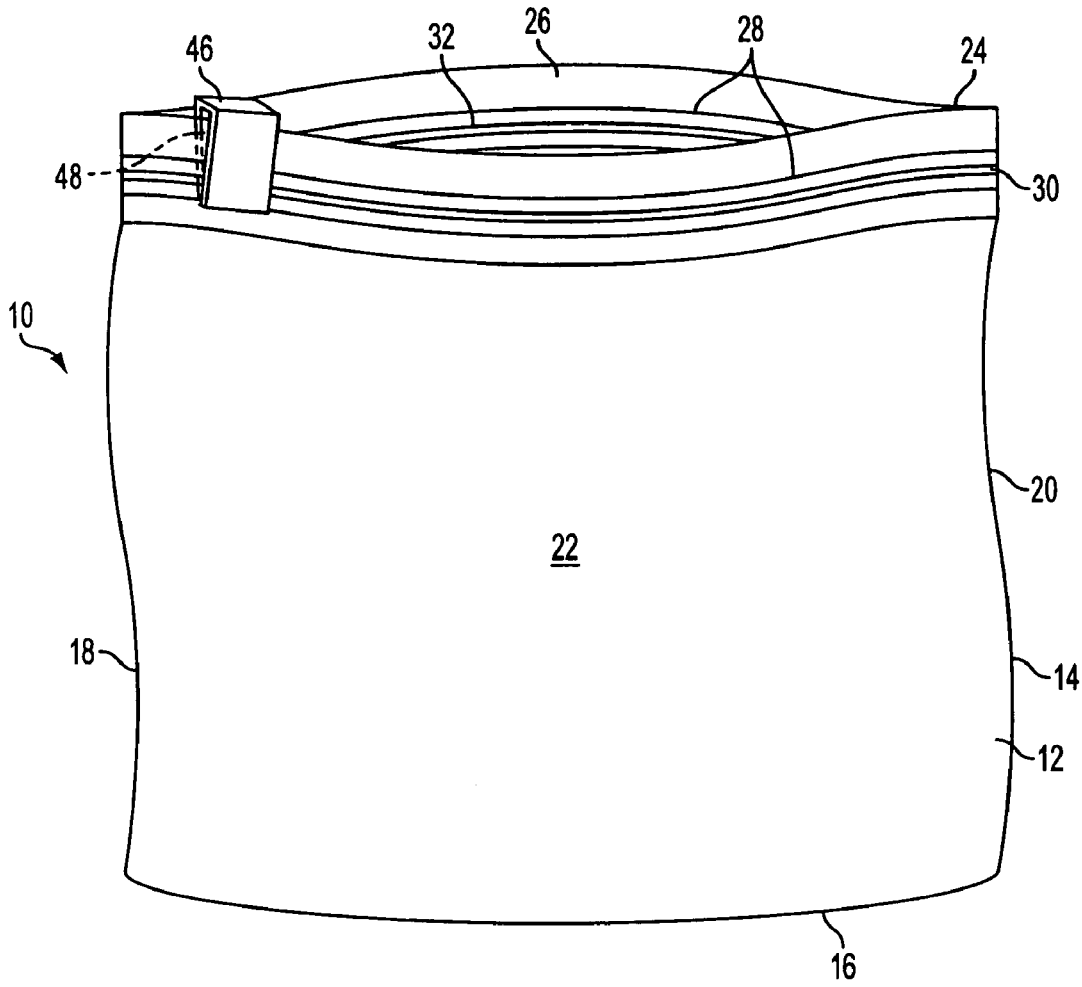
FIG. 4 is a perspective view of another embodiment of the present invention.

Referring to FIG. 4, another embodiment of the blocking structure of the present invention, the resealable bag 10 further comprises a clip-shaped spacer 46 having an obstructing portion 48 that is or may be placed in the opening 26 of the bag 10 near the end of the opening 26 to which the spacer 46 is temporarily attached. The obstructing portion of the clip-shaped spacer may consist of one side of the clip. And, said clip-shaped spacer may be removably attached.

The general manufacturing techniques of the sealable bags of the present invention, including the resealable bags 10 of the preferred and other embodiments, are well-known in the art and may be easily adapted by one of ordinary skill in the relevant art to the manufacture and attachment of the spacer of the present invention. Of course, the present invention is not, unless specifically claimed in the claim at issue, dependent on the method of manufacture.

In an alternative embodiment of the blocking structure, the spacer, instead of being permanently attached, is removably attached. For instance, the spacer is attached to a tensioned clip such that the clip may be removably attached to a standard resealable bag as is known in the art at substantially the same place on the standard bag as the spacer 40 is attached to the resealable bag 10 in FIG. 3. Any other fastener suitable for being removably attached to a standard resealable bag may alternatively be used.

In another alternative embodiment of the blocking structure, the clip-shaped spacer's obstructing portion is removably attached to the body of the spacer. And, alternatively, the clip-shaped spacer with a removably attached obstructing portion may be formed such that it can also function as a closing slide for the interlocking tongue and groove system.

Figure 5A:
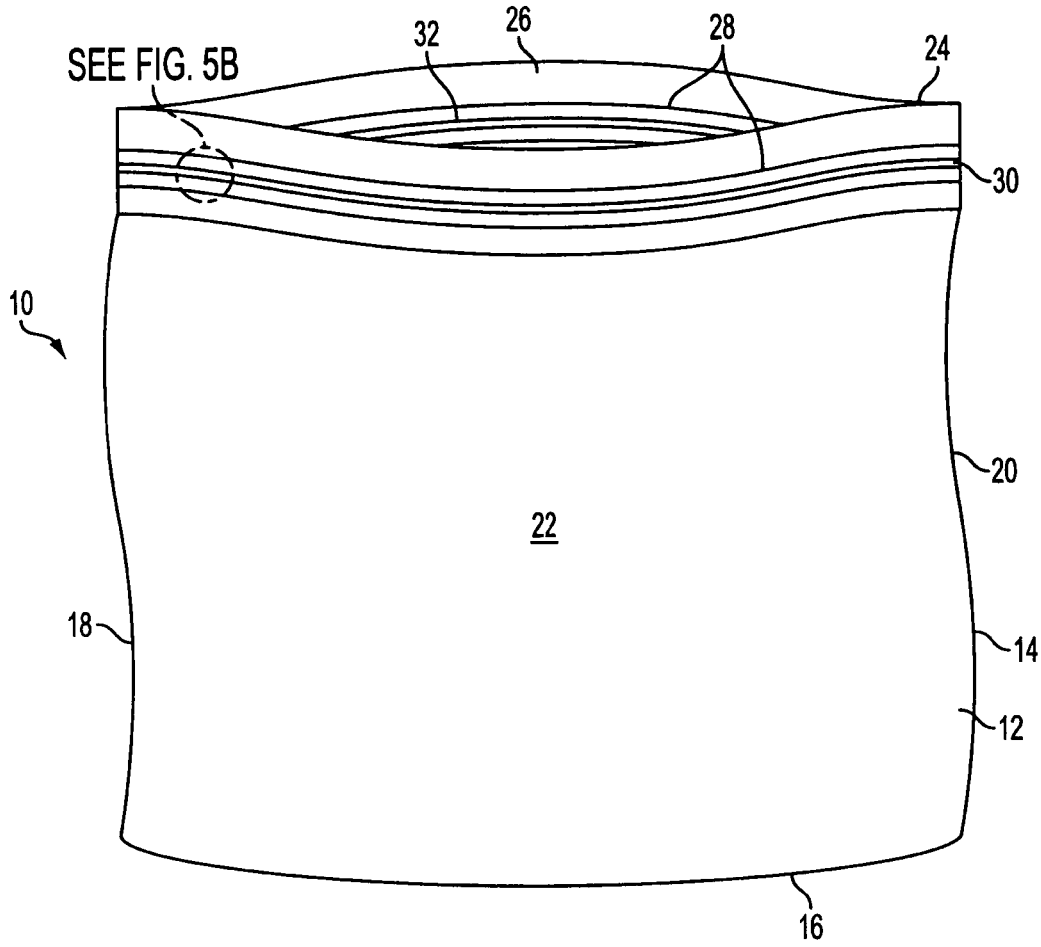
FIG. 5*a* is a perspective view of another embodiment of the present invention.
Figure 5B:
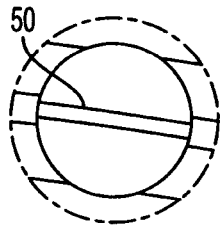
FIG. 5*b* is a cutout of the perspective view of FIG. 5*a*.

Referring to FIGS. 5*a* and 5*b*, in a further alternative embodiment of the blocking structure, a deformation, 50 e.g., a bump or enlargement, is incorporated into (or could be located on or sufficiently near) the interlocking tongue and grove strips 30, 32 near one of the ends of the opening 26, where said deformation 50 provides a temporary stop during sealing of the bag 10 such that a small portion of the opening 26 remains unsealed for the evacuation of excess air after which the sealing can be completed by pressing harder to bypass the deformation 50 and seal the bag 10 completely.

Figure 6:
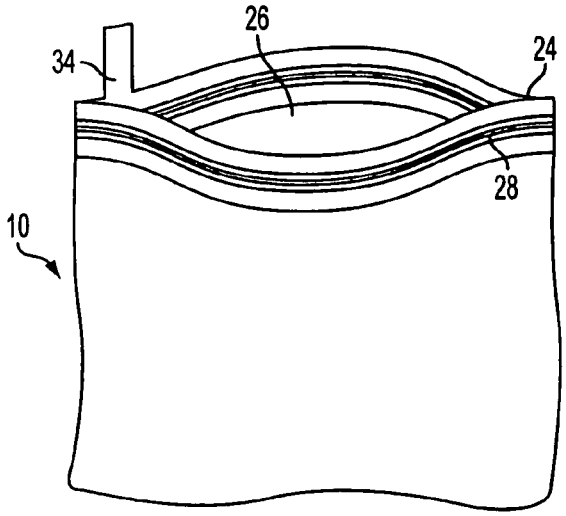
FIG. 6 is a perspective view of the resealable bag of the preferred embodiment of the present invention with the opening of the bag opened and the spacer withdrawn from the opening.
Figure 7:
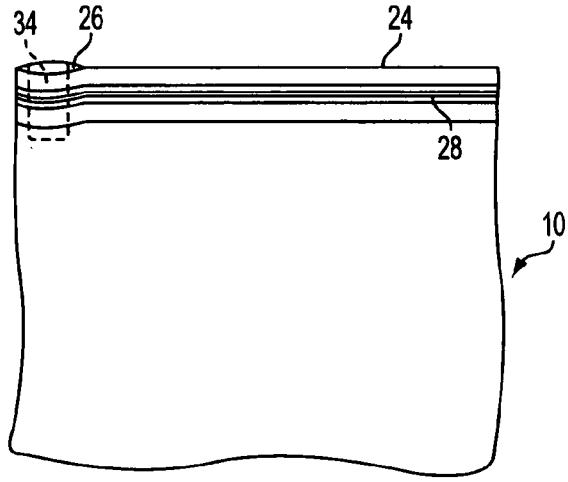
FIG. 7 is a perspective view of the resealable bag of the preferred embodiment of the present invention with the opening of the bag partially closed and the spacer inserted into the opening temporarily blocking the complete sealing of the opening.
Figure 8:
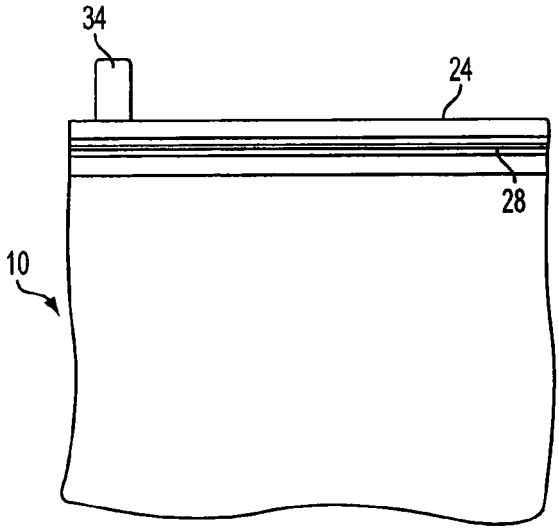
FIG. 8 is a perspective view of the resealable bag of the preferred embodiment of the present invention with the opening of the bag closed.

Referring to FIGS. 6-8, with the top end 24 open as in FIG. 6, the resealable bag 10 of the first preferred embodiment may be loaded with food, perishables, household items or any other article suitable for storage in standard resealable bags as known in the art. After loading, the spacer 34 is inserted into the opening 26 defined by the top end 24 (or the spacer 34 is pre-placed in the opening 26) and the tongue and groove system 28 is closed up to the point at which the spacer 34 is inserted in the opening 26 such that the vast majority of the tongue and groove system 28 is in the closed position, leaving only a small portion of the top end 24 open as shown in FIG. 7. Any excess air in the bag 10 may then be squeezed out of the bag through the remaining opening 26 of the top end 24 held open by the spacer 34. Thereafter, as in FIG. 8, the spacer 34 is withdrawn from the opening 26, the tongue and groove system 28 is completely closed thus sealing the top end 24 and providing a substantially air tight seal of the bag 10.

Other embodiments of the present invention may be envisioned by one of skill in the art. For instance, the size, shape, material and manufacturing methods of the resealable bag may be varied. Or, the sealable bag of the present invention may not be a resealable bag at all, instead being a once sealable bag or a resealable bag other than the type encompassing Zip-Lock® and Glad-Lock® resealable bags. And, the tongue and groove system of the preferred embodiment may be replaced with any system capable of sealing the sealable bag of the present invention in a substantially airtight manner. Furthermore, the size, flexibility, material, attaching structure and other characteristics of the blocking structure may be varied as desired as long as the blocking structure is capable of temporarily preventing the complete closure of the bag. For instance, a spacer blocking structure can be scored to more easily facilitate folding of the spacer for insertion into the opening of the bag.

What is claimed is:

1. A sealable bag comprising:

a pouch defined by one or more sections of substantially airtight material joined together in a substantially airtight manner such that a single unsectioned opening having at least one end is left for accessing said pouch;

a substantially airtight sealing system in association with said unsectioned opening; and a blocking structure substantially permanently attached to said sections of substantially airtight material near said unsectioned opening proximate to said end;

wherein said substantially airtight sealing system is an interlocking tongue and groove system and said blocking structure is a tab-like spacer comprising a first end and a second end, said first end attached to one of said sections of substantially airtight material at said unsectioned opening such that said second end is capable of placement in said unsectioned opening.

2. The sealable bag of claim 1, wherein said interlocking tongue and groove system is molded integrally with said sections of substantially airtight material.

3. The sealable bag of claim 1, wherein said interlocking tongue and groove system is affixed parallel to the edges of said fourth unsealed sides in close proximity to said unsectioned opening.

4. The sealable bag of claim 1, wherein said interlocking tongue and groove system is affixed to the edges of said fourth unsealed sides.

5. The sealable bag of claim 1, wherein said blocking structure is integrally molded to said sections of substantially airtight material near said unsectioned opening proximate to said end.

6. The sealable bag of claim 1, wherein said blocking structure is welded to said sections of substantially airtight material near said unsectioned opening proximate to said end.

7. The sealable bag of claim 1, wherein said one or more sections of substantially airtight material joined together in a substantially airtight manner comprises opposing substantially rectangular panel sections wherein three sets of sides of the rectangular panel sections are sealed in a substantially airtight manner leaving the fourth set of sides unsealed and defining said unsectioned opening.

8. The sealable bag of claim 7, wherein said blocking structure is integrally molded to said sections of substantially airtight material near said unsectioned opening proximate to said end.

9. The sealable bag of claim 7, wherein said blocking structure is welded to said sections of substantially airtight material near said unsectioned opening proximate to said end.

10. A sealable bag comprising:

a pouch defined by one or more sections of substantially airtight material joined together in a substantially airtight manner such that a single unsectioned opening having at least one end is left for accessing said pouch;

a substantially airtight sealing system in association with said unsectioned opening; and a blocking structure substantially permanently attached to said sections of substantially airtight material near said unsectioned opening proximate to said end;

wherein said substantially airtight sealing system is an interlocking tongue and groove system and said blocking structure is a generally thin and elongated spacer comprising a first end and a second end, said first end attached to one or more of said sections of substantially airtight material near said unsectioned opening such that said second end may be inserted in said unsectioned opening.

11. The sealable bag of claim 10, wherein said interlocking tongue and groove system is molded integrally with said sections of substantially airtight material.

12. The sealable bag of claim 10, wherein said interlocking tongue and groove system is affixed parallel to the edges of said fourth unsealed sides in close proximity to said unsectioned opening.

13. The sealable bag of claim 10, wherein said interlocking tongue and groove system is affixed to the edges of said fourth unsealed sides.

14. The sealable bag of claim 10, wherein said blocking structure is integrally molded to said sections of substantially airtight material near said unsectioned opening proximate to said end.

15. The sealable bag of claim 10, wherein said blocking structure is welded to said sections of substantially airtight material near said unsectioned opening proximate to said end.

16. The sealable bag of claim 10, wherein said one or more sections of substantially airtight material joined together in a substantially airtight manner comprises opposing substantially rectangular panel sections wherein three sets of sides of the rectangular panel sections are sealed in a substantially airtight manner leaving the fourth set of sides unsealed and defining said unsectioned opening.

17. The sealable bag of claim 16, wherein said blocking structure is integrally molded to said sections of substantially airtight material near said unsectioned opening proximate to said end.

18. The sealable bag of claim 16, wherein said blocking structure is welded to said sections of substantially airtight material near said unsectioned opening proximate to said end.

19. An evacuation system for a sealable bag comprising:

a substantially airtight bag with a single continuous opening;

a substantially airtight sealing system affixed to said bag for sealing said opening wherein said substantially airtight sealing system has at least one substantially permanently sealed end; and, a spacer substantially permanently attached to said bag near said opening at the substantially permanently sealed end of said substantially airtight sealing system, said spacer having at least one end, said end capable of temporary placement in said opening such that said substantially airtight sealing system is prevented from completely sealing.

20. The evacuation system of claim 19, wherein said substantially airtight sealing system is an interlocking tongue and groove system.

21. The sealable bag of claim 19, wherein said blocking structure is integrally molded to said sections of substantially airtight material near said unsectioned opening proximate to said end.

22. The sealable bag of claim 19, wherein said blocking structure is welded to said sections of substantially airtight material near said unsectioned opening proximate to said end.

23. The sealable bag of claim 19, wherein said substantially airtight bag comprises opposing substantially rectangular panel sections wherein three sets of sides of the rectangular panel sections are sealed in a substantially airtight manner leaving the fourth set of sides unsealed and defining said opening.

24. The sealable bag of claim 23, wherein said blocking structure is integrally molded to said sections of substantially airtight material near said unsectioned opening proximate to said end.

25. The sealable bag of claim 23, wherein said blocking structure is welded to said sections of substantially airtight material near said unsectioned opening proximate to said end.

* * * * *